US012006116B2

(12) United States Patent
Smalley

(10) Patent No.: US 12,006,116 B2
(45) Date of Patent: Jun. 11, 2024

(54) CARRIER WITH HANDLE FEATURES

(71) Applicant: Graphic Packaging International, LLC, Atlanta, GA (US)

(72) Inventor: Brian Smalley, Bristol (GB)

(73) Assignee: Graphic Packaging International, LLC, Atlanta, GA (US)

( * ) Notice: Subject to any disclaimer, the term of this patent is extended or adjusted under 35 U.S.C. 154(b) by 41 days.

(21) Appl. No.: 17/590,258

(22) Filed: Feb. 1, 2022

(65) Prior Publication Data

US 2022/0153494 A1 May 19, 2022

Related U.S. Application Data

(62) Division of application No. 16/253,803, filed on Jan. 22, 2019, now Pat. No. 11,305,924.
(Continued)

(51) Int. Cl.
*B65D 71/32* (2006.01)
*B65D 71/20* (2006.01)
(Continued)

(52) U.S. Cl.
CPC ..... *B65D 71/32* (2013.01); *B65D 71/20* (2013.01); *B65D 71/22* (2013.01); *B65D 71/30* (2013.01);
(Continued)

(58) Field of Classification Search
CPC ..... B65D 71/32; B65D 71/20; B65D 71/22; B65D 2571/00141; B65D 2571/00277;
(Continued)

(56) References Cited

U.S. PATENT DOCUMENTS 687,968 A 12/1901 Reber
1,253,193 A 1/1918 Hill
(Continued)

FOREIGN PATENT DOCUMENTS

BE 671.762 3/1966
CA 877792 8/1971
(Continued)

OTHER PUBLICATIONS

China Recycle luxury 4 pack paper beer carrier box Manufacturer & Supplier. [online] Published on Aug. 18, 2014. Retrieved Feb. 19, 2019 from URL: http://www.globalmarket.com/product-info/recycle-luxury-4-pack-paper-beer-carrier-box-6214358.html.
(Continued)

*Primary Examiner* — Jacob K Ackun
(74) *Attorney, Agent, or Firm* — Womble Bond Dickinson (US) LLP

(57) ABSTRACT

A carrier for holding at least one article includes a plurality of panels and a handle. The plurality of panels extends at least partially around an interior of the carrier, and the plurality of panels includes a top panel, a bottom panel, and at least one side panel. The handle includes at least one handle feature in the top panel. The at least one handle feature includes a plurality of foldably connected handle sections that includes a first outer section and a second outer section each foldably connected to a central section and such that the at least one handle feature is positionable between a first, substantially flat configuration and a second, substantially recessed configuration wherein the handle is activated for carrying the carrier.

26 Claims, 10 Drawing Sheets

Related U.S. Application Data

(60) Provisional application No. 62/620,537, filed on Jan. 23, 2018.

(51) Int. Cl.
*B65D 71/22* (2006.01)
*B65D 71/30* (2006.01)

(52) U.S. Cl.
CPC ..... *B65D 2571/00141* (2013.01); *B65D 2571/00277* (2013.01); *B65D 2571/0029* (2013.01); *B65D 2571/00296* (2013.01); *B65D 2571/00444* (2013.01); *B65D 2571/00456* (2013.01); *B65D 2571/00475* (2013.01); *B65D 2571/0066* (2013.01); *B65D 2571/00716* (2013.01); *B65D 2571/00728* (2013.01); *B65D 2571/00845* (2013.01)

(58) Field of Classification Search
CPC .. B65D 2571/0029; B65D 2571/00444; B65D 2571/00475; B65D 2571/0066; B65D 2571/00716; B65D 2571/00845
See application file for complete search history.

(56) References Cited

U.S. PATENT DOCUMENTS 2,375,631 A 5/1945 DeVillard
2,383,183 A 8/1945 Fischer
2,594,376 A 4/1952 Arneson
2,702,144 A 2/1955 Forrer
2,718,301 A 9/1955 Palmer
2,785,847 A 3/1957 Forrer
2,797,856 A 7/1957 Jaeschke
2,810,506 A 10/1957 Kessler
2,811,250 A 10/1957 Arneson
2,849,111 A 8/1958 Fielding
2,868,433 A 1/1959 Anderson, Jr.
2,872,036 A 2/1959 Forrer
2,874,869 A 2/1959 Hennessey
2,922,561 A 1/1960 Currivan
2,928,541 A 3/1960 Fielding
2,955,739 A 10/1960 Collura
3,112,856 A 12/1963 MacIntosh et al.
3,127,720 A 4/1964 Gentry et al.
3,178,242 A 4/1965 Ellis
3,204,815 A 9/1965 Weiss
3,257,066 A 6/1966 Williams
3,269,531 A 8/1966 Weiss
3,300,115 A 1/1967 Schauer
3,306,519 A 2/1967 Wood
3,309,005 A 3/1967 Pilger
3,334,767 A 8/1967 Cornelius et al.
3,339,723 A * 9/1967 Wood ..... B65D 71/36 206/196
3,353,709 A 11/1967 Lawrence
3,355,012 A 11/1967 Weiss
3,356,279 A 12/1967 Root
3,371,846 A 3/1968 Detzel
3,373,867 A 3/1968 Wood
3,381,881 A 5/1968 Granz et al.
3,554,402 A 1/1971 Lock
3,593,849 A 7/1971 Helms
3,635,452 A 1/1972 Helms
3,669,342 A 6/1972 Funkhouser
3,746,245 A 7/1973 Oglesbee
3,747,835 A 7/1973 Graser
3,767,042 A 10/1973 Ganz
3,828,926 A 8/1974 Rossi
3,869,079 A 3/1975 Oglesbee
3,886,901 A 6/1975 Zeitler
3,904,036 A 9/1975 Forrer
3,933,303 A 1/1976 Kirby, Jr.
3,963,121 A 6/1976 Kipp
3,994,432 A 11/1976 Kirby, Jr.
4,010,593 A 3/1977 Graham
4,029,204 A 6/1977 Manizza
4,034,852 A 7/1977 Forrer
4,036,423 A 7/1977 Gordon
4,096,985 A 6/1978 Wood
4,101,069 A 7/1978 Wood
4,111,306 A 9/1978 Roccaforte
4,202,446 A 5/1980 Sutherland
4,216,861 A 8/1980 Oliff
4,222,485 A 9/1980 Focke
4,295,562 A 10/1981 Wood
4,300,680 A * 11/1981 Champlin ..... B65D 71/36 206/427
4,314,634 A 2/1982 Stone
4,318,474 A 3/1982 Hasegawa
4,327,829 A 5/1982 Hughes
4,328,893 A 5/1982 Oliff
4,328,923 A 5/1982 Graser
4,331,289 A 5/1982 Killy
4,339,070 A 7/1982 Davies
4,364,509 A 12/1982 Holley, Jr.
4,375,258 A 3/1983 Crayne
4,378,905 A 4/1983 Roccaforte
4,382,505 A 5/1983 Sutherland
4,394,903 A 7/1983 Bakx
4,405,078 A 9/1983 Dutcher
4,424,901 A 1/1984 Lanier
4,440,340 A 4/1984 Bakx
4,470,503 A 9/1984 Stone
4,478,334 A 10/1984 Graser
4,498,619 A 2/1985 Roccaforte
4,508,258 A 4/1985 Graser
4,533,047 A 8/1985 Calvert
4,538,759 A 9/1985 Dutcher
4,545,485 A 10/1985 Oliff
4,546,914 A 10/1985 Roccaforte
4,558,816 A 12/1985 Wood
4,566,593 A 1/1986 Muller
4,577,799 A 3/1986 Oliff
4,582,199 A 4/1986 Schuster
4,588,084 A 5/1986 Holley, Jr.
4,637,515 A 1/1987 Wilson
4,653,686 A 3/1987 Wood
4,681,217 A 7/1987 Hernandez
4,681,252 A 7/1987 Doerr
4,684,059 A 8/1987 Rusnock
4,706,876 A 11/1987 Wilson
4,728,025 A 3/1988 Oliff
4,728,026 A 3/1988 Schuster
4,747,487 A 5/1988 Wood
4,747,534 A 5/1988 Marie
4,784,266 A 11/1988 Chaussadas
4,784,316 A 11/1988 Crouch
4,785,991 A 11/1988 Schuster
4,802,583 A 2/1989 Calvert
4,804,089 A 2/1989 Wilson
4,811,894 A 3/1989 Schuster
4,830,267 A 5/1989 Wilson
4,838,479 A 6/1989 Wood
4,875,585 A 10/1989 Kadleck
4,875,586 A 10/1989 Chaussadas
RE33,110 E 11/1989 Wood
4,901,849 A 2/1990 Wilson
4,919,266 A * 4/1990 McIntosh, Jr. ..... B65D 71/14 206/427
4,958,734 A 9/1990 Wood
4,966,324 A 10/1990 Steel
4,972,991 A 11/1990 Schuster
4,974,771 A 12/1990 Lavery
4,981,253 A 1/1991 Quaintance
5,000,313 A * 3/1991 Oliff ..... B65D 71/16 206/427
5,002,186 A 3/1991 Cooper
D316,672 S 5/1991 Wood
5,020,337 A 6/1991 Krieg
D318,802 S 8/1991 Egide
D319,388 S 8/1991 McIntosh, Jr.
5,042,660 A 8/1991 Carver
5,060,792 A 10/1991 Oliff

(56) References Cited

U.S. PATENT DOCUMENTS 5,072,876 A 12/1991 Wilson
5,094,359 A 3/1992 DeMars
5,106,014 A * 4/1992 Miller ..... B65D 5/4608 229/117.12
5,108,030 A 4/1992 Schuster
5,119,985 A 6/1992 Dawson
5,131,588 A 7/1992 Oliff
5,180,100 A 1/1993 Shimizu
5,195,676 A 3/1993 LeBras
5,197,598 A 3/1993 Stout
5,221,041 A 6/1993 Stout
5,222,658 A 6/1993 DeMaio
5,234,102 A 8/1993 Schuster
5,246,112 A 9/1993 Stout et al.
5,284,294 A 2/1994 Floyd
5,292,058 A 3/1994 Zoss
5,292,059 A 3/1994 Oliff
5,297,673 A 3/1994 Sutherland
5,297,725 A 3/1994 Sutherland
5,303,863 A 4/1994 Arasim
5,307,932 A 5/1994 Stout
5,307,986 A 5/1994 Schuster
5,320,277 A 6/1994 Stout
5,333,734 A 8/1994 Stout
D350,480 S 9/1994 Sutherland
5,351,878 A 10/1994 Cooper
5,379,944 A 1/1995 Stout
5,381,891 A 1/1995 Harris
5,385,234 A 1/1995 Stout
5,395,044 A 3/1995 Stout
5,421,458 A 6/1995 Campbell
5,427,241 A 6/1995 Sutherland
5,458,234 A 10/1995 Harris
5,472,090 A 12/1995 Sutherland
5,472,138 A 12/1995 Ingram
5,480,091 A 1/1996 Stout
5,482,203 A 1/1996 Stout
5,485,915 A 1/1996 Harris
5,495,727 A 3/1996 Strong
5,495,943 A * 3/1996 Bienaime ..... B65D 71/38 206/427
5,505,372 A 4/1996 Edson et al.
5,524,756 A 6/1996 Sutherland
5,542,536 A 8/1996 Sutherland
5,549,197 A 8/1996 Sutherland
D373,306 S 9/1996 Baxter
5,551,556 A 9/1996 Sutherland
5,558,212 A 9/1996 Sutherland
5,558,213 A 9/1996 Sutherland
5,582,343 A 12/1996 Dalvey
5,593,027 A 1/1997 Sutherland
5,595,291 A 1/1997 Negelen
5,597,071 A 1/1997 Sutherland
5,609,251 A 3/1997 Harris
5,639,017 A 6/1997 Fogle
5,647,483 A 7/1997 Harris
5,664,401 A 9/1997 Portrait et al.
5,669,500 A 9/1997 Sutherland
5,682,995 A 11/1997 Sutherland
5,692,614 A 12/1997 Harris
5,699,957 A 12/1997 Blin
5,704,470 A 1/1998 Sutherland
5,738,273 A 4/1998 Auclair
D395,007 S 6/1998 Miller
5,778,630 A 7/1998 Portrait et al.
5,794,778 A 8/1998 Harris
5,796,778 A 8/1998 Kurker
5,819,920 A 10/1998 Sutherland
5,826,782 A 10/1998 Stout
5,826,783 A 10/1998 Stout
5,853,088 A 12/1998 Saulas et al.
5,855,318 A 1/1999 Baxter
5,873,515 A 2/1999 Dunn
5,878,946 A 3/1999 Frerot
5,906,313 A 5/1999 Oliff
5,915,546 A 6/1999 Harrelson
5,931,300 A 8/1999 Sutherland
5,937,620 A 8/1999 Chalendar
5,941,453 A 8/1999 Oliff
5,943,847 A 8/1999 Chalendar
5,947,367 A 9/1999 Miller et al.
D415,423 S 10/1999 Miller
5,975,286 A 11/1999 Oliff
5,992,733 A 11/1999 Gomes
5,996,883 A 12/1999 Bates
6,019,220 A 2/2000 Sutherland
6,019,276 A 2/2000 Auclair
6,021,898 A 2/2000 Sutherland
6,021,899 A 2/2000 Sutherland
6,065,590 A 5/2000 Spivey
6,105,853 A 8/2000 Lamare
6,105,854 A 8/2000 Spivey
6,109,438 A 8/2000 Sutherland
6,126,066 A 10/2000 Peterson
6,129,266 A 10/2000 Oliff
6,131,803 A 10/2000 Oliff
6,155,480 A 12/2000 Botsford et al.
6,158,586 A 12/2000 Muller
6,164,526 A 12/2000 Dalvey
6,170,741 B1 1/2001 Skolik
6,227,367 B1 5/2001 Harrelson et al.
6,237,839 B1 5/2001 Brown
6,250,542 B1 6/2001 Negelen
6,260,755 B1 7/2001 Bates
6,273,330 B1 8/2001 Oliff
6,289,651 B1 9/2001 Le Bras
6,302,320 B1 10/2001 Stout
6,315,123 B1 11/2001 Ikeda
D456,710 S 5/2002 Persson
6,425,520 B1 7/2002 Peterson
6,484,903 B2 11/2002 Spivey
6,523,739 B2 2/2003 Heeley
6,536,656 B2 3/2003 Auclair
6,550,616 B2 4/2003 Le Bras
6,631,803 B2 10/2003 Rhodes
6,695,137 B2 2/2004 Jones
6,758,337 B2 7/2004 Chargueraud
6,766,940 B2 7/2004 Negelen
6,811,525 B2 11/2004 Culpepper
6,848,573 B2 2/2005 Gould
6,866,185 B2 3/2005 Harrelson
6,896,130 B2 5/2005 Theelen
6,905,066 B2 6/2005 Holley, Jr.
6,926,193 B2 8/2005 Smalley
6,942,140 B2 9/2005 Merzeau
6,948,651 B2 9/2005 Ikeda
6,968,992 B2 11/2005 Schuster
6,981,631 B2 1/2006 Fogle et al.
6,988,617 B2 1/2006 Gomes et al.
D516,439 S 3/2006 Cargile, Jr.
7,007,800 B2 3/2006 Le Bras
7,007,836 B2 3/2006 Smalley
D531,026 S 10/2006 McMorris
7,134,593 B2 * 11/2006 Harrelson ..... B65D 5/4608 206/427
7,159,759 B2 1/2007 Sutherland
7,273,161 B2 9/2007 Fogle
7,427,010 B2 9/2008 Sutherland
7,448,492 B2 11/2008 Sutherland
7,472,791 B2 1/2009 Spivey, Sr.
7,743,968 B2 6/2010 Theelen
D620,354 S 7/2010 Block
7,748,603 B2 7/2010 Fogle
7,757,933 B2 7/2010 Dunn
7,762,397 B2 * 7/2010 Coltri-Johnson ..... B65D 71/30 206/427
7,793,779 B2 9/2010 Spivey, Sr.
7,806,314 B2 10/2010 Sutherland
7,874,477 B2 * 1/2011 Sutherland ..... B65D 71/36 206/427
7,900,815 B2 * 3/2011 Shmagin ..... B65D 71/20 206/139
7,913,844 B2 * 3/2011 Spivey, Sr. ..... B65D 71/16 206/427

(56) References Cited

U.S. PATENT DOCUMENTS

| | | | | |
|---|---|---|---|---|
| 8,348,142 | B2 | 1/2013 | Smalley | |
| 8,453,920 | B2 * | 6/2013 | Schemmel | B65D 71/36 206/427 |
| 8,985,433 | B2 | 3/2015 | Sutherland | |
| 9,199,774 | B2 | 12/2015 | Smalley et al. | |
| D765,500 | S | 9/2016 | Brown | |
| 9,567,120 | B2 * | 2/2017 | Spivey, Sr. | B65D 71/36 |
| 2003/0000182 | A1 | 1/2003 | Portrait et al. | |
| 2003/0132130 | A1 | 7/2003 | Bras | |
| 2003/0213263 | A1 | 11/2003 | Woog | |
| 2004/0011674 | A1 | 1/2004 | Theelen | |
| 2004/0074854 | A1 | 4/2004 | Lin | |
| 2004/0089671 | A1 | 5/2004 | Miller | |
| 2004/0188277 | A1 | 9/2004 | Auclair | |
| 2004/0188301 | A1 | 9/2004 | Gomes | |
| 2004/0243277 | A1 | 12/2004 | Bonnain et al. | |
| 2004/0254666 | A1 | 12/2004 | Bonnain et al. | |
| 2005/0001020 | A1 | 1/2005 | Gamier | |
| 2005/0056658 | A1 | 3/2005 | Spivey | |
| 2005/0167478 | A1 | 8/2005 | Holley | |
| 2005/0178791 | A1 | 8/2005 | Miller | |
| 2005/0194430 | A1 | 9/2005 | Auclair et al. | |
| 2006/0169755 | A1 | 8/2006 | Spivey | |
| 2006/0191811 | A1 | 8/2006 | Fogle et al. | |
| 2006/0237520 | A1 | 10/2006 | Cargile, Jr. | |
| 2006/0255108 | A1 * | 11/2006 | Shmagin | B65D 71/30 229/117.12 |
| 2006/0273143 | A1 | 12/2006 | Finch | |
| 2007/0017962 | A1 | 1/2007 | Russ | |
| 2007/0029371 | A1 | 2/2007 | Theelen | |
| 2007/0039846 | A1 | 2/2007 | Spivey | |
| 2007/0051781 | A1 | 3/2007 | Holley | |
| 2007/0108261 | A1 | 5/2007 | Schuster | |
| 2007/0158226 | A1 | 7/2007 | Coltri-Johnson et al. | |
| 2007/0164091 | A1 | 7/2007 | Fogle | |
| 2007/0181658 | A1 | 8/2007 | Sutherland | |
| 2007/0205255 | A1 | 9/2007 | Dunn | |
| 2007/0295789 | A1 | 12/2007 | Ho Fung | |
| 2008/0067223 | A1 | 3/2008 | Jego | |
| 2008/0073420 | A1 | 3/2008 | Walling | |
| 2009/0236408 | A1 | 9/2009 | Spivey | |
| 2010/0213249 | A1 | 8/2010 | Requena | |
| 2011/0036902 | A1 | 2/2011 | Smalley | |
| 2011/0131926 | A1 * | 6/2011 | Coltri-Johnson | B65D 71/36 53/458 |
| 2015/0291328 | A1 | 10/2015 | Blin | |
| 2016/0167829 | A1 | 6/2016 | Spivey, Sr. et al. | |

FOREIGN PATENT DOCUMENTS

| | | |
|---|---|---|
| CA | 1 243 987 | 11/1988 |
| CA | 2 160 145 | 9/1995 |
| DE | 85 14 718.4 | 6/1985 |
| DE | 90 06 306 U1 | 9/1990 |
| DE | 91 04 905.9 | 6/1991 |
| DE | 92 03 58.1 | 5/1992 |
| DE | 92 03 858.1 | 5/1992 |
| DE | 296 07 374 | 4/1996 |
| DE | 201 12 228 | 11/2002 |
| DE | 20 2004 018 649 | 4/2005 |
| EP | 0 459 658 | 12/1991 |
| EP | 0 473 266 | 3/1992 |
| EP | 0 509 749 | 10/1992 |
| EP | 0 520 411 | 12/1992 |
| EP | 1 612 157 | 1/2006 |
| EP | 2 149 506 | 2/2010 |
| FR | 1 438 035 | 1/1965 |
| FR | 2 698 074 | 5/1994 |
| GB | 1101345 | 1/1968 |
| GB | 2202825 | 10/1988 |
| GB | 2209515 | 5/1989 |
| JP | 5-112373 | 5/1993 |
| JP | 7-11566 | 2/1995 |
| JP | H08-2551 | 1/1996 |
| JP | 10-338266 | 12/1998 |
| JP | 2003-200967 | 7/2003 |
| JP | 2004-533378 | 11/2004 |
| WO | WO 96/27538 | 9/1996 |
| WO | WO 97/27124 | 7/1997 |
| WO | WO 98/09871 | 3/1998 |
| WO | WO 99/28207 | 6/1999 |
| WO | WO 00/78618 | 12/2000 |
| WO | WO 01/66434 | 9/2001 |
| WO | WO 02/102208 | 12/2002 |
| WO | WO 03/004377 | 1/2003 |
| WO | WO 03/008292 | 1/2003 |
| WO | WO 03/037742 | 5/2003 |
| WO | WO 2005/080218 | 9/2005 |
| WO | WO 2005/042370 | 12/2005 |
| WO | WO 2005/123532 | 12/2005 |
| WO | WO 2007/089282 | 8/2007 |
| WO | WO 2009/117562 | 9/2009 |
| WO | WO 2011/022378 | 2/2011 |
| WO | WO 2013/142814 A1 | 9/2013 |
| WO | WO 2016/089942 A1 | 6/2016 |
| WO | WO 2017/091375 A1 | 6/2017 |

OTHER PUBLICATIONS

Izze Sparkling Blackberry Juice Beverage 4 PK Cans. [online] Retrieved Jan. 9, 2019 from URL: https://allergeninside.com/foods/ingredients/836093012022/1zze-Sparkling-Blackberry-Juice-Beverage-4-PK-Cans.

International Search Report and Written Opinion for PCT/US2019/014509 dated May 9, 2019.

Supplementary European Search Report for EP 19 74 3890 dated Sep. 28, 2021.

Notice of Allowance and Fee(s) Due for U.S. Appl. No. 16/253,803 dated Jan. 18, 2022.

Request for Continued Examination (RCE) Transmittal for U.S. Appl. No. 16/253,803 dated Jan. 6, 2022.

Amendment B and Response to Final Office Action for U.S. Appl. No. 16/253,803 dated Jan. 6, 2022.

Office Action for U.S. Appl. No. 16/253,803 dated Oct. 8, 2021.

Amendment A and Response to Office Action for U.S. Appl. No. 16/253,803 dated Aug. 17, 2021.

Office Action for U.S. Appl. No. 16/253,803 dated May 20, 2021.

Response to Restriction Requirement for U.S. Appl. No. 16/253,803 dated Feb. 15, 2021.

Office Action for U.S. Appl. No. 16/253,803 dated Jan. 14, 2021.

* cited by examiner

CARRIER WITH HANDLE FEATURES

CROSS-REFERENCE TO RELATED APPLICATION

This application is a divisional of U.S. patent application Ser. No. 16/253,803, which was filed on Jan. 22, 2019, which claims the benefit of U.S. Provisional Patent Application No. 62/620,537, which was filed on Jan. 23, 2018.

INCORPORATION BY REFERENCE

The disclosures of U.S. patent application Ser. No. 16/253,803, which was filed on Jan. 22, 2019, and U.S. Provisional Patent Application No. 62/620,537, which was filed on Jan. 23, 2018, are hereby incorporated by reference for all purposes as if presented herein in their entirety.

BACKGROUND OF THE DISCLOSURE

The present disclosure relates to cartons or carriers, blanks for forming cartons or carriers, and methods associated with cartons or carriers and associated blanks for holding and carrying at least one article. In one embodiment, the present disclosure relates to a carrier having handle features to facilitate carrying of the carrier.

SUMMARY OF THE DISCLOSURE

According to one aspect of the disclosure, a carrier for holding at least one article comprises a plurality of panels that extends at least partially around an interior of the carrier, the plurality of panels comprising a top panel, a bottom panel, and at least one side panel. The carrier further comprises a handle that comprises at least one handle feature in the top panel, the at least one handle feature comprises a plurality of foldably connected handle sections that comprises a first outer section and a second outer section each foldably connected to a central section. The at least one handle feature is positionable between a first, substantially flat configuration and a second, substantially recessed configuration wherein the handle is activated for carrying the carrier.

According to another aspect of the disclosure, a blank for forming a carrier for holding at least one article comprises a plurality of panels comprising a top panel, a bottom panel, and at least one side panel. The blank further comprises at least one handle feature in the top panel for forming a handle of the carrier formed from the blank, and the at least one handle feature comprises a plurality of foldably connected handle sections that comprises a first outer section and a second outer section each foldably connected to a central section. The at least one handle feature is positionable between a first, substantially flat configuration and a second, substantially recessed configuration wherein the handle is activated for carrying the carrier formed from the According to another aspect of the disclosure, a method of forming a carrier for holding at least one article comprises obtaining a blank, the blank comprises a plurality of panels comprising a top panel, a bottom panel, and at least one side panel. The blank further comprises at least one handle feature in the top panel for forming a handle, the at least one handle feature comprises a plurality of foldably connected handle sections that comprises a first outer section and second outer section each foldably connected to a central section. The method further comprises folding the plurality of panels at least partially around an interior of the carrier and such that the at least one handle feature is positionable between a first, substantially flat configuration and a second, substantially recessed configuration wherein the handle is activated for carrying the carrier.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

Cartons or carriers according to the present disclosure can accommodate articles of numerous different shapes. For the purpose of illustration and not for the purpose of limiting the scope of the disclosure, the following detailed description describes articles such as containers, bottles, cans, etc., that at least partially disposed within the carton or carrier embodiments. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons or carriers according to the present disclosure can accommodate articles of any shape. For the purpose of illustration and not for the purpose of limiting the scope of the disclosure, the following detailed description describes beverage containers (e.g., aluminum beverage cans or glass bottles) as disposed within the carton or carrier embodiments. In this specification, the terms “lower,” “bottom,” “upper,” and “top” indicate orientations determined in relation to fully erected and upright cartons or carriers. As described herein, cartons or carriers may be formed from blanks by overlapping multiple portions, panels, and/or end flaps. Such portions, panels, and/or end flaps may be designated herein in terms relative to one another, e.g., "first", "second", "third", etc., in sequential or non-sequential reference, without departing from the disclosure.

Figure 1:
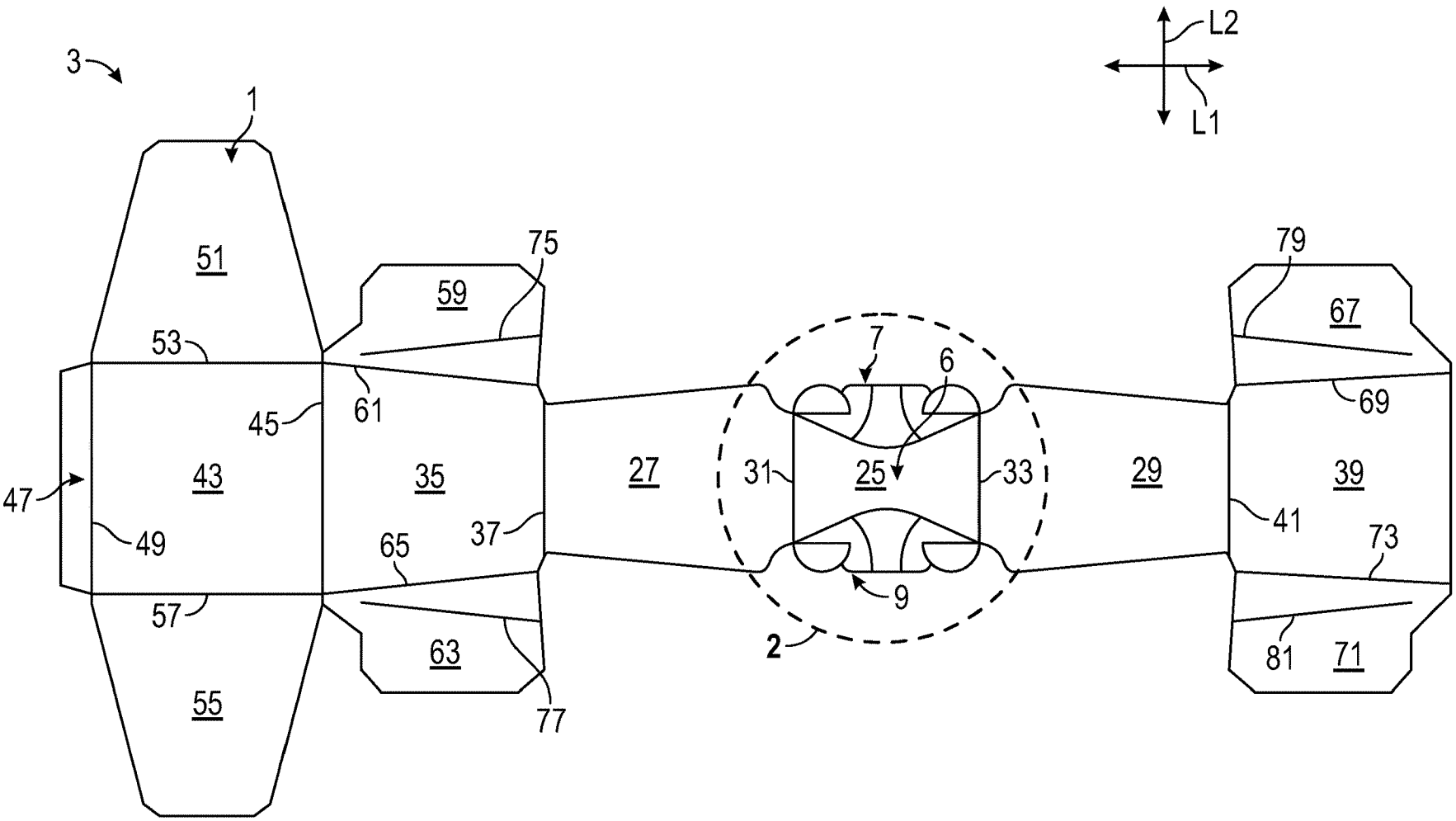
FIG. 1 is a plan view of an exterior surface of a blank for forming a carrier according to a first exemplary embodiment of the disclosure.
Figure 2:
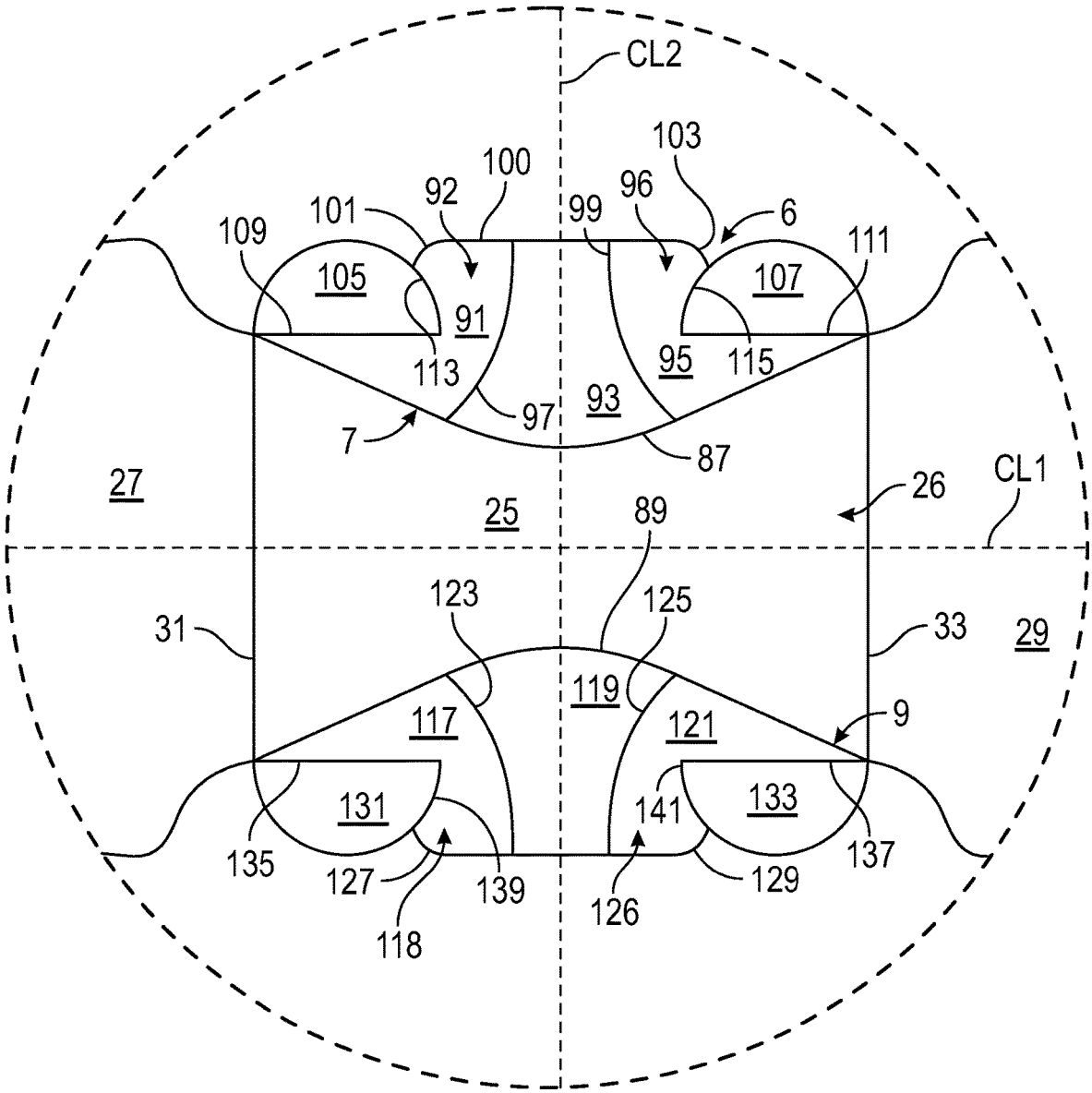
FIG. 2 is an enlarged view of the area identified in FIG. 1.

FIGS. 1 and 2 are plan views of an exterior surface 1 of a blank 3 that can be obtained for forming a carton or carrier 5 (FIG. 5) according to a first exemplary embodiment of the disclosure. The carrier 5 can be used to hold at least one article A (FIG. 4), such as beverage bottles or cans. As shown, the carrier 5 is provided with a handle 6 comprising handle features 7, 9 (broadly, respective "first handle features" and "second handle features") that are positionable to facilitate carrying of the carrier 5 by a user. It will be understood that one or both handle features 7, 9 can be provided without departing from the disclosure.

The blank 3, as shown, has a longitudinal axis L1 and a lateral axis L2. The blank 3 includes a top panel 25 with handle features 7, 9, as described further herein. As shown, the top panel 25 is foldably connected to a first upper side panel 27 and a second upper side panel 29 at respective lateral fold lines 31, 33. As shown, a first lower side panel 35 is foldably connected to the first upper side panel 27 at a lateral fold line 37, and a second lower side panel 39 is foldably connected to the second upper side panel 29 at a lateral fold line 41. As also shown, a bottom panel 43 is foldably connected to the first lower side panel 35 at a lateral fold line 45. An attachment flap 47 can be foldably attached to the bottom panel 43 at a lateral fold line 49, as shown.

As shown in FIG. 1, a first bottom end flap 51 is foldably connected to the bottom panel 43 at longitudinal fold line 53, and a second bottom end flap 55 is foldably connected to the bottom panel 43 at a longitudinal fold line 57. As also shown, a first side end flap 59 is foldably connected to the first lower side panel 35 at an oblique fold line 61, a second side end flap 63 is foldably connected to the first lower side panel 35 at an oblique fold line 65, a third side end flap 67 is foldably connected to the second lower side panel 39 at an oblique fold line 69, and a fourth side end flap 71 is foldably connected to the second lower side panel 39 at an oblique fold line 73. Respective oblique fold lines 75, 77, 79, 81, as shown, can extend from a respective free edge of the respective end flaps 59, 63, 67, 71 to an interior portion of the respective end flaps 59, 63, 67, 71. In this regard, the end flaps 51, 59, 67 extend along a first marginal area of the blank 3, and the end flaps 55, 63, 71 extend along a second marginal area of the blank 3.

FIG. 2 illustrates the handle features 7, 9 of the top panel 25 in detail. As shown, each handle feature 7, 9 is at least partially defined by respective fold lines 87, 89 that have an at least partially curved configuration, as shown, and which each intersect the fold lines 31, 33 at respective endpoints thereof. In this regard, the respective handle features 7, 9 are formed between the respective fold lines 87, 89 and the respective free edges of the top panel 25. As shown, each of the fold lines 87, 89 may have a substantially convex configuration with regard to a longitudinal centerline CL1 of the top panel 25, e.g., each fold line 87, 89 extends toward its respective endpoints in a direction extending away from the longitudinal centerline CL1.

As shown, the handle feature 7 includes a plurality of handle portions or sections 91, 93, 95, with the central section 93 (broadly, "first central section") being centrally disposed between the two longitudinally marginal or outer sections 91 (broadly, "first outer section"), 95 (broadly, "second outer section"). As shown, the central section 93 is foldably connected to the outer section 91 at a curved fold line 97 (broadly, "first curved fold line") and the central section 93 is foldably connected to the outer section 95 at a curved fold line 99 (broadly, "second curved fold line"). In the illustrated embodiment, the curved fold lines 97, 99 each extend from the curved fold line 87 to a free edge of the top panel 25 such that the curved fold line 87 is a common curved fold line (broadly, "first common curved fold line") at which the central section 93 and the outer sections 91, 95 are foldably connected to a body portion 26 of the top panel 25. As shown, each of the outer sections 91, 95 includes laterally marginal portions 92, 96 thereof that present respective locking edges 101, 103. In the illustrated embodiment, each of the curved fold lines 97, 99 has a generally convex configuration with reference to a lateral centerline CL2 of the top panel 25, e.g., each curved fold line 97, 99 extends toward its respective endpoints in a direction extending away from the lateral centerline CL2. In this regard, and as shown, the central section 93 has a configuration that generally tapers from the fold line 87 to the free edge of the top panel 25.

Still referring to FIGS. 1 and 2, a first tab 105 is foldably connected to the outer section 91 at a longitudinal fold line 109 and a second tab 107 is foldably connected to the outer section 95 at a longitudinal fold line 111. In the illustrated embodiment, each tab 105, 107 has a semicircular configuration and is at least partially defined by curved cuts 113, 115 in the top panel 25 that separate the respective tabs 105, 107 from the respective marginal portions 92, 96 of the respective outer sections 91, 95 and at least partially define the respective locking edges 101, 103. The handle feature 7 could be otherwise shaped, arranged, and/or configured without departing from the disclosure.

The handle feature 9 can have similarly-configured features to the handle features 7 described above. In particular, the handle feature 9 includes a central section 119 (broadly, "second central handle section"), and two outer sections 117 (broadly, "third outer handle section"), 121 (broadly, "fourth outer handle section"), with the central section 119 foldably connected to the outer sections 117, 121 at a respective curved fold lines 123, 125 that are convex relative to the lateral centerline CL2. The sections 117, 119, 121 of handle feature 9 are each foldably connected to a portion of the curved fold line 89 such that the fold line 89 is a common curved fold line (broadly, "second common curved fold line"). Outer sections 117, 121 have respective marginal portions 118, 120 with respective locking edges 127, 129, and tabs 131, 133 are foldably connected to the respective outer sections 117, 121 at respective fold lines 135, 137. The locking edges 127, 129 are at least partially defined by and are at least partially separated from the respective tabs 131, 133 at respective curved cuts 139, 141. One or both of the handle features 7, 9 can be differently-configured without departing from the disclosure.

Figure 3:
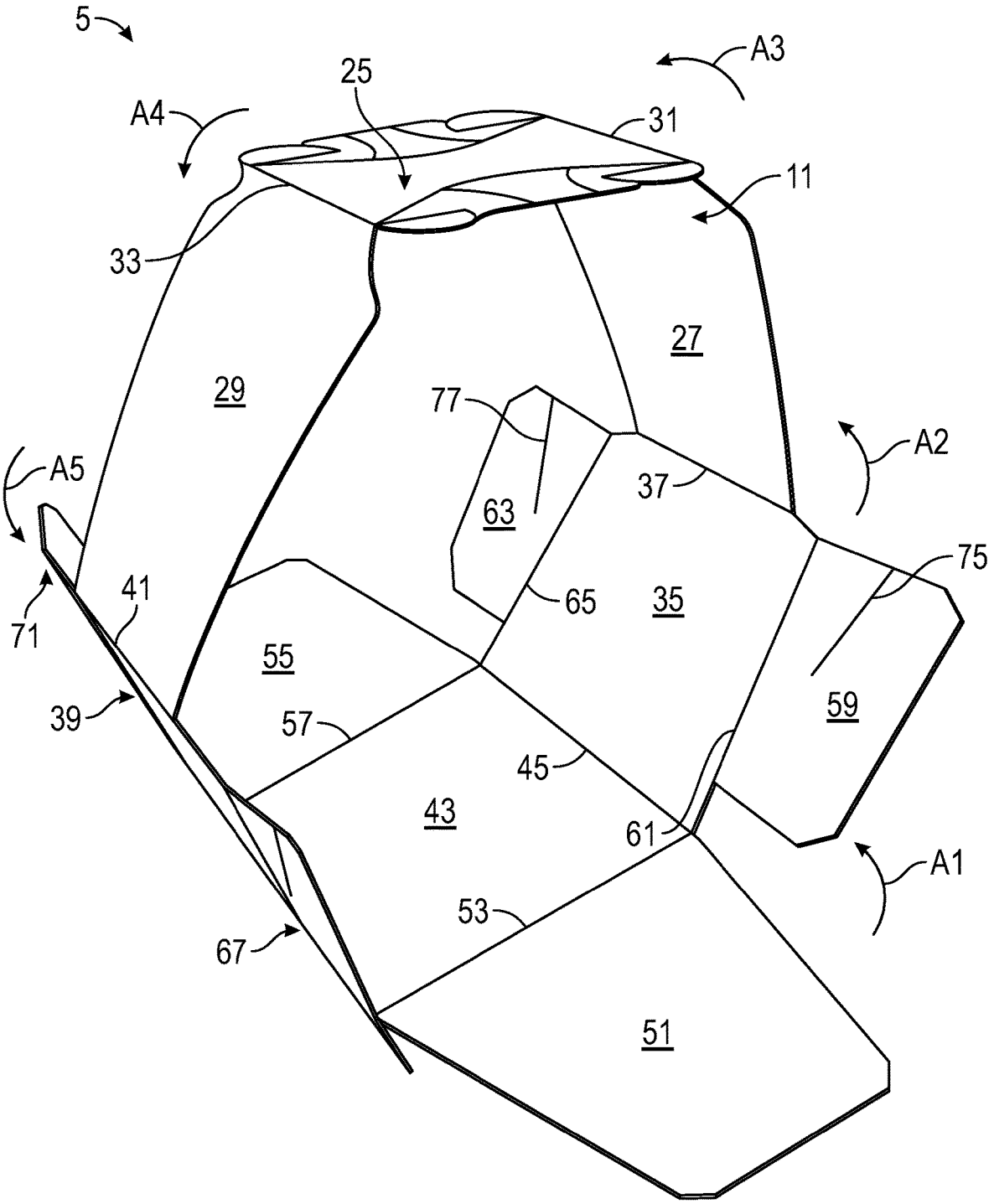
FIG. 3 is a first sequential perspective view of an assembly of a carrier formed from the blank of FIG. 1.
Figure 4:
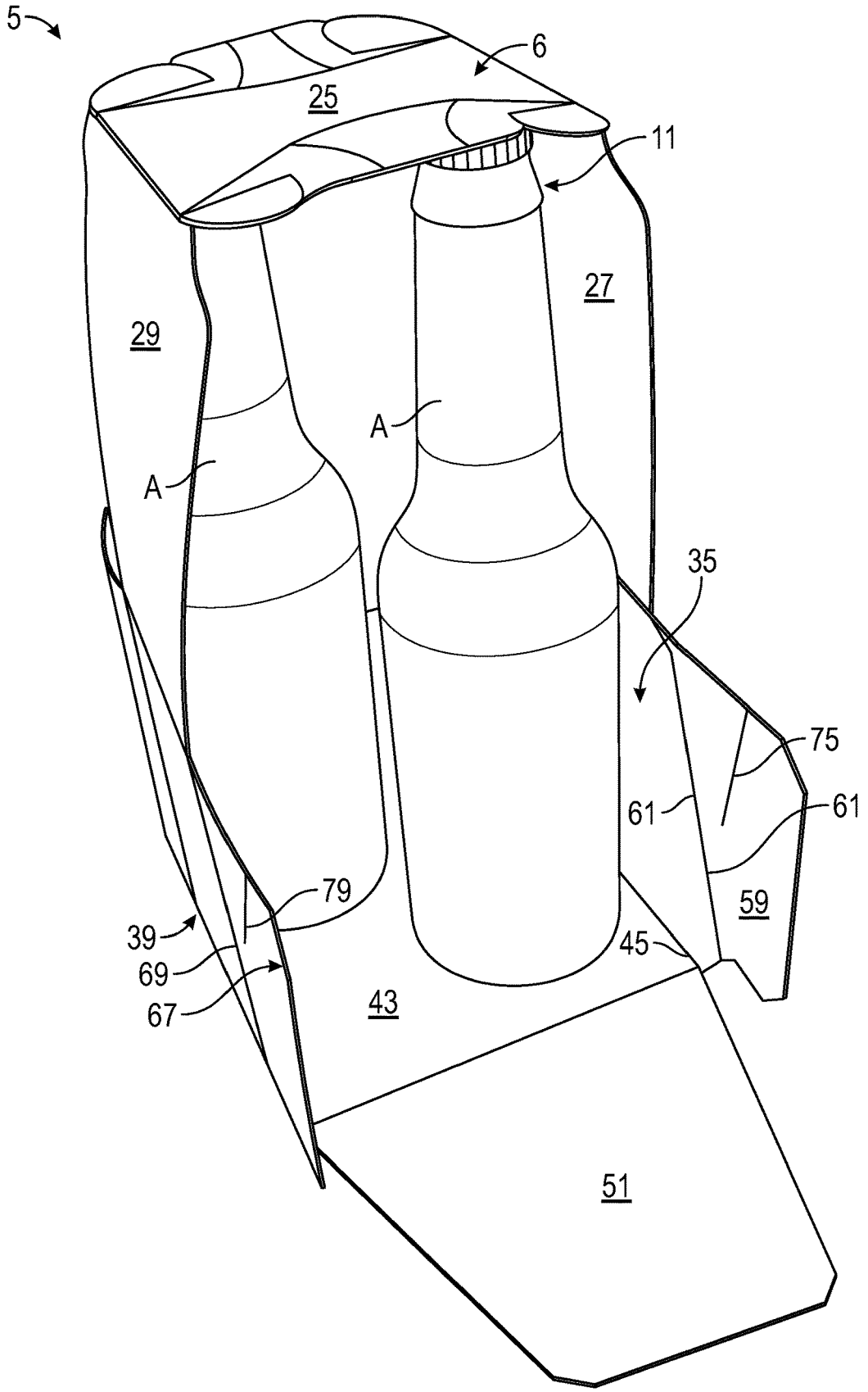
FIG. 4 is a second sequential perspective view of an assembly of a carrier formed from the blank of FIG. 1.

Turning additionally to FIGS. 3 and 4, the formation of the carrier 5 from the blank 3 according to one exemplary embodiment of the disclosure will be described. The panels 43, 35, 27, 25, 29, and 39 can be folded relative to one another at one or more of the fold lines 45, 37, 31, 33, and 41 in the direction of the respective arrows A1, A2, A3, A4, A5 such that the panels 43, 35, 27, 25, 29, 39 extend at least partially around an interior 11 of the carrier 5. The attachment flap 47 can be folded at the fold line 49 and placed in at least partial overlapping relation, e.g., at least partial face-to-face contact, with the second lower side panel 39, and can be secured thereto, for example, with an adhesive such as glue. As shown, the top panel 25 and the bottom panel 43 can be disposed in substantially parallel spaced relation, with the respective first upper side panel and first lower side panel 27, 35 and the respective second upper side panel and second lower side panel 29, 39 extending between the top panel 25 and the bottom panel 43. As shown, the respective upper side panels 27, 29 may be obliquely disposed relative to the respective lower side panels 35, 39. Such an arrangement can be facilitated by, for example, the presence of one or more articles A (shown in FIG. 4) in the carrier 5. In the illustrated partially-formed configuration of the carrier 5, a sleeve-like arrangement is provided within which one or more articles A, e.g., beverage containers, can be inserted into the interior 11 of the carrier 5. Alternatively, the carrier 5 can be formed by wrapping the blank 3 around the group of articles A to be contained in the interior.

Figure 5:
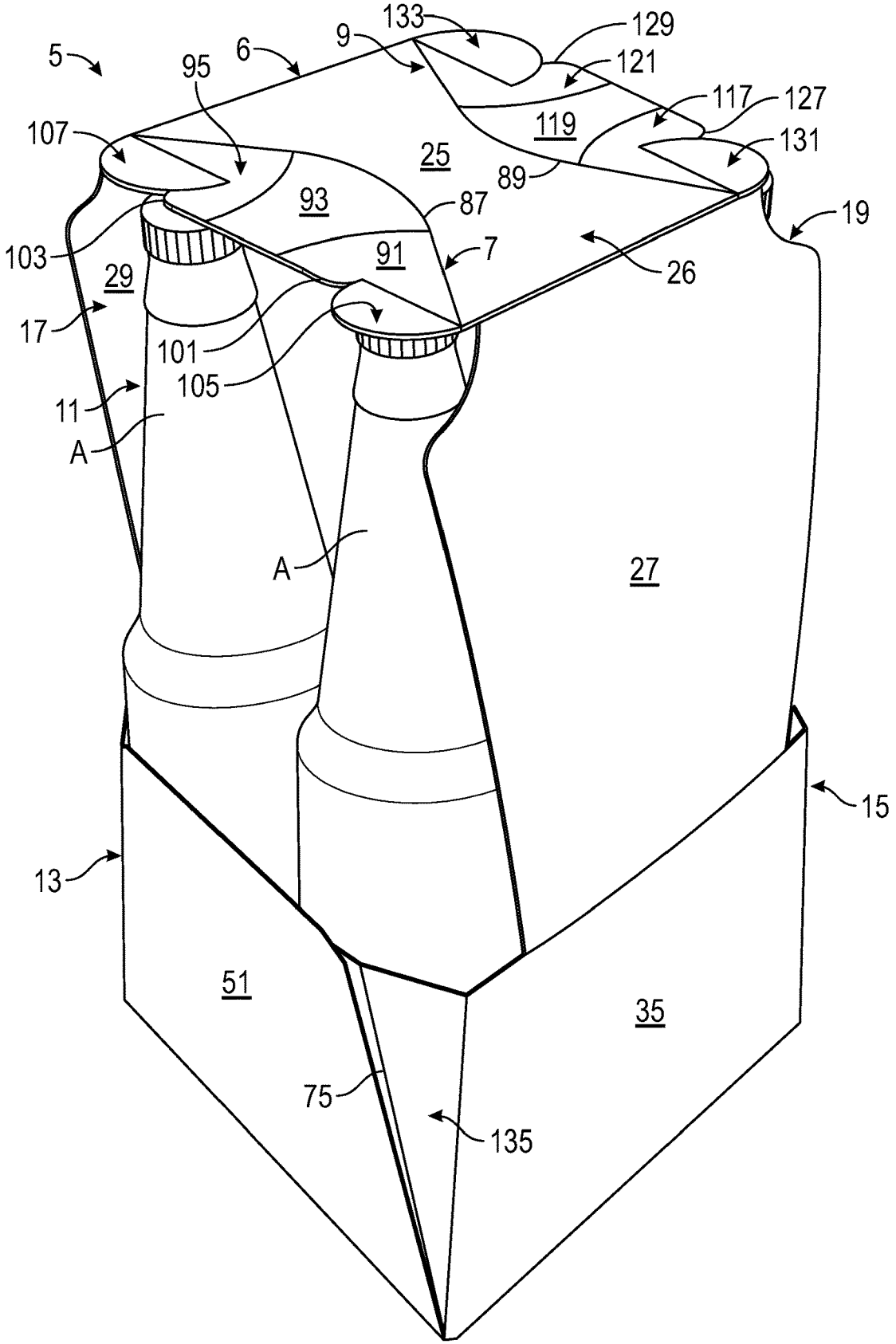
FIG. 5 is a perspective view of a carrier formed from the blank of FIG. 1 according to the first exemplary embodiment of the disclosure, and with at least one handle feature in a first configuration.

Still referring to FIGS. 3 and 4, and referring additionally to FIG. 5, once a desired number of articles A are loaded into the interior 11 of the carrier 5, the side end flaps 59, 67 can be folded at respective fold lines 61, 69 toward one another in the direction of the respective arrows A6, A7 into at least partial overlapping relation to at least partially close a first end 13 of the carrier 5. Similarly, the side end flaps 63, 71 can be folded toward each other at respective fold lines 65, 73 into at least partial overlapping relation to at least partially close a second end 15 of the carrier 5. As shown, one or more of the side end flaps 59, 67, 63, 71 may at least partially fold at respective fold lines 75, 79, 77, 81, for example, in at least partial engagement of one or more articles A disposed in the carrier 5, such that the carrier 5 can be provided with one or more shaped corner sections 135 formed by relative folding of portions of the respective side flaps 59, 63, 67, 71 at the respective oblique fold lines 75, 77,79, 81. The corner sections 135 can have a configuration that is, for example, obliquely-angled, curved, rounded, or chamfered, to name a few. The bottom end flaps 51, 55 can then be folded upwardly at the respective fold lines 53, 57 into at least partial overlapping relation with the respective side end flaps 59, 67 and 63, 71.

In this regard, and as shown, each end 13, 15 of the carrier 5 defines a respective opening 17, 19 along an upper portion thereof into the interior 11 of the carrier 5, for example, to view portions of one or more articles A (such as to provide graphics and/or labeling that includes marketing, pricing, and/or other identifying or descriptive information) and/or to access portions of the one or more articles A, for example, to facilitate removal thereof from the carrier 5.

Figure 6:
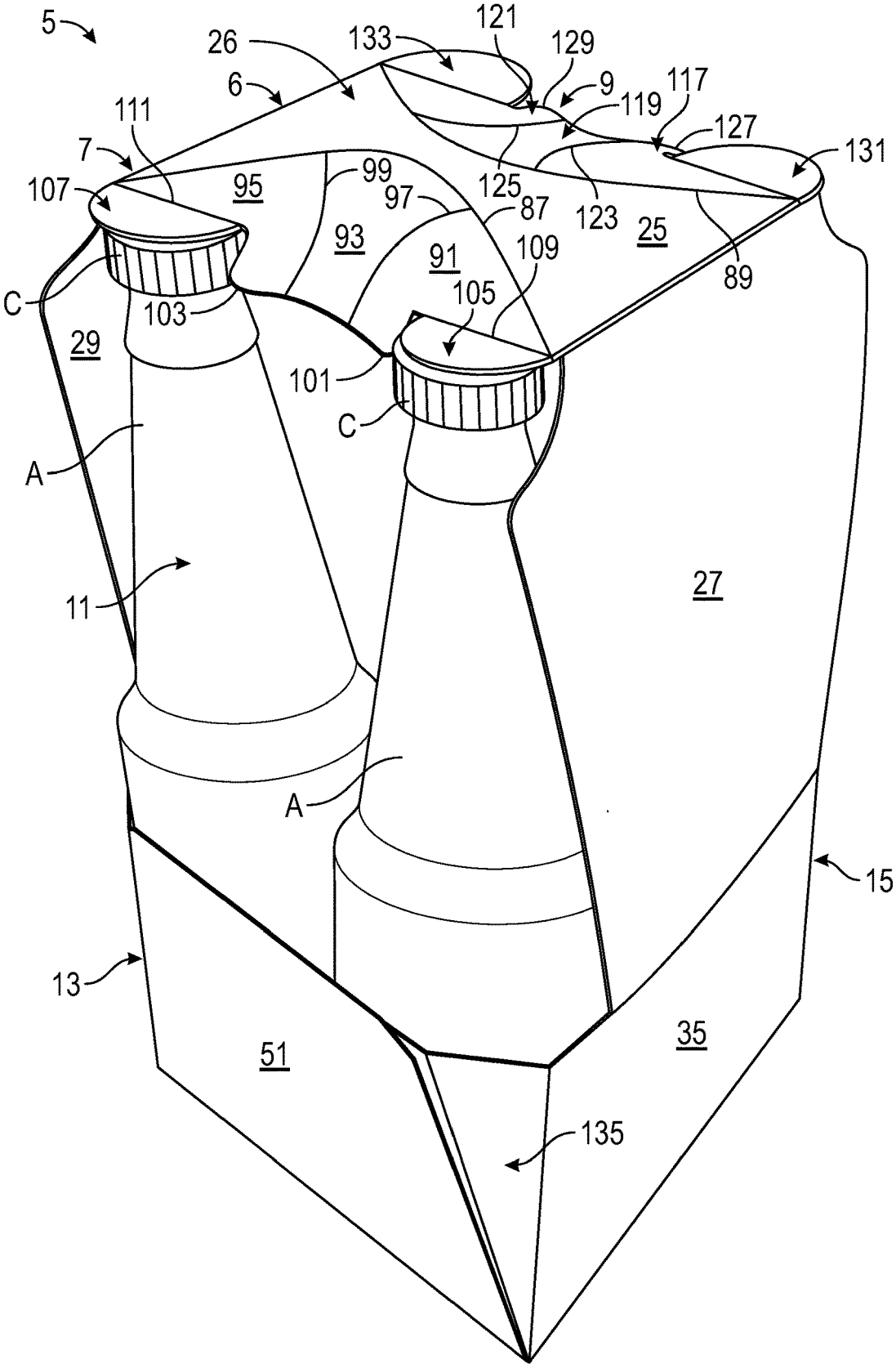
FIG. 6 is a perspective view of the carrier of FIG. 5 with the at least one handle feature in a second configuration.

Referring additionally to FIG. 6, a user can engage the handle 6 by activating one or both of the handle features 7, 9 to facilitate carrying of the carrier 5. As shown, the handle features 7, 9 are regions of the carrier 5 that are configured to at least partially deform, e.g., bend, crush, crumple, and/or fold, in order to present one or more surfaces that facilitate engagement by a user, for example, a user's fingers. As shown, the respective sections 91, 93, 95 and 117, 119, 121 are configured for relative movement to one another such that the respective handle features 7, 9 deform downwardly or inwardly, e.g., toward and/or at least partially into the interior 11 of the carrier 5. In the activated position of the handle 6, the handle features 7, 9 can deform into respective substantially concave recesses relative to the body portion 26 of the top panel 25. The respective locking edges 101, 103 and 127, 129 of the respective handle sections 91, 95, 117, 121 can engage portions of the articles A, for example, ridges of caps C of the articles A, to lock or otherwise maintain the handle features 7, 9 in the activated position. In addition, the tabs 105, 107, 131, 133 are configured to be positioned in overlying face-to-face contact with the caps C of the articles A when the handle 6 is activated. In one embodiment, the tabs 105, 107, 131, 133 can provide a barrier between a portion of a user, for example, the fingers of a user's hand, and one or more articles A in the interior 11 of the carrier 5.

In one configuration, as shown, the central section 93 of the handle feature 7 can be pressed downwardly to at least partially fold at the fold line 87 into substantially oblique or substantially perpendicular arrangement with the body portion 26 of the top panel 25. Such movement of the central section 93 causes the respective outer sections 91, 95 to become downwardly disposed relative to the body portion 26 of the top panel 25 and obliquely disposed relative to the central section 93 by folding at the respective fold line 87 and the curved fold line 97, and at the fold line 87 and the curved fold line 99, respectively, to form the recessed configuration of the handle 6. In such an arrangement, locking edges 101, 103 can engage ridges in the caps C of the articles A to lock or maintain the arrangement of the handle feature 7 in the activated position. In such a configuration of the handle feature 7, the sections 91, 93, 95 may engage a portion of a user's fingers, for example, by at least partially hugging, clamping, and/or clasping around a user's fingers in a non-injurious fashion, such that the user is provided with a comfortable and secured engagement of the carrier 5 upon engagement of the handle feature 7. The tabs 105, 107 are positioned to rest upon the caps C of the articles A as described above. In this regard, the handle feature 7 is configured to transition between a first, substantially flat configuration, and a second, activated or substantially recessed configuration as described above.

The handle feature 9 can be engaged and activated by a user from a first, flat configuration to a second, recessed configuration in a similar manner as described above with respect to the handle feature 7, for example, so that the central section 119 is pressed downwardly to at least partially fold at the fold line 89 into substantially oblique or substantially perpendicular arrangement with the body portion 26 of the top panel 25, and with the outer sections 117, 119 downwardly disposed relative to the body portion 26 of the top panel 25 and obliquely disposed relative to the central section 103 by folding at the respective fold line 89 and the curved fold line 123 and at the fold line 89 and the curved fold line 125 to form the recessed configuration of the handle 6. The locking edges 127, 129 can engage ridges in the caps C of the articles A to lock or maintain the handle feature 9 in an activated position. In the activated position, the respective tabs 131, 133 are positioned to rest upon the caps C of the articles A as described above with respect to the handle feature 7. In the activated position of the handle 6, the body portion 26 of the top panel 25 between the fold lines 87, 89 can be generally arched upwardly between the side panels 27, 29 to facilitate grasping the handle 6, for example, by contacting a portion of a user's hand.

It will be understood that one or both of the handle features 7, 9 can have a different pattern of deformation, or that the patterns of deformation described above can occur differently, e.g., in a different order, without departing from the disclosure.

Figure 7:
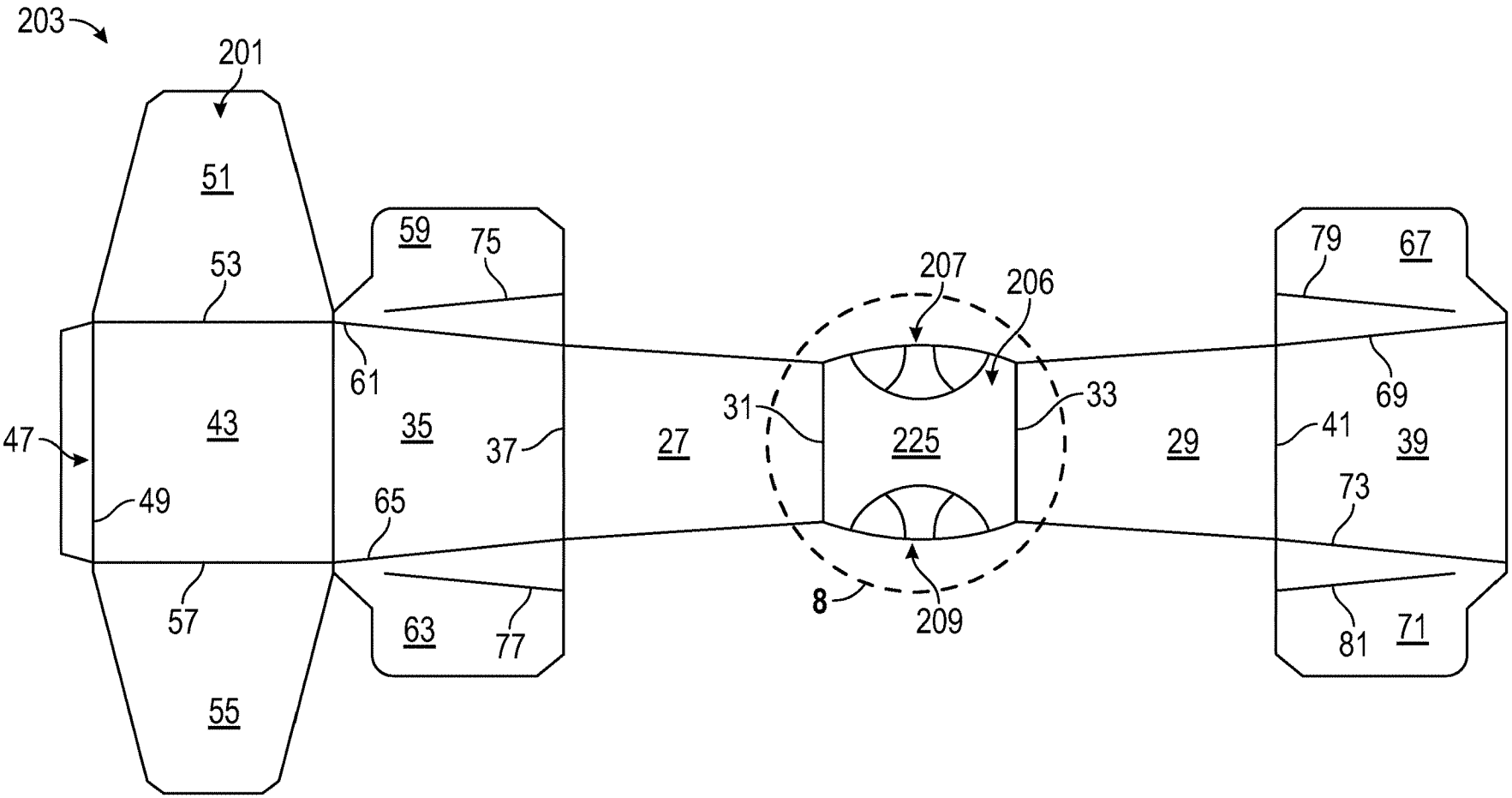
FIG. 7 is a plan view of an exterior surface of a blank for forming a carrier according to a second exemplary embodiment of the disclosure.
Figure 8:
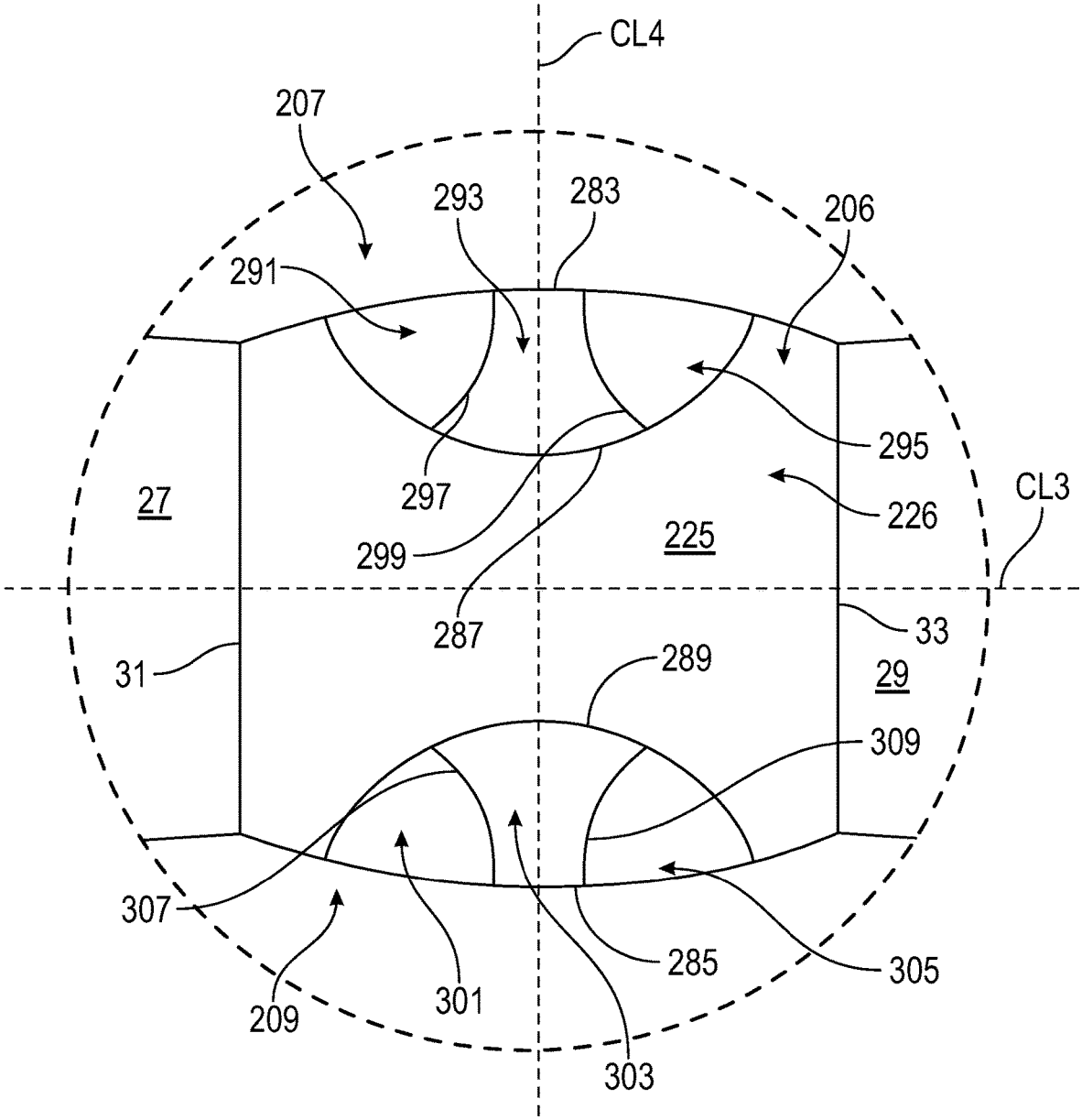
FIG. 8 is an enlarged view of the area identified in FIG. 7.

Turning now to FIGS. 7 and 8, an exterior surface 201 of a blank 203 that can be obtained for forming carton or carrier 205 (FIG. 9) according to a second exemplary embodiment of the disclosure is illustrated. The blank 203 and the carrier 205 may have similar features to the blank 3 (FIG. 1) and the carrier 5 (FIG. 5) described above, and like or similar reference numbers are used to designate like or similar features.

As shown, the blank 203 includes a top panel 225 having a handle 206 comprising handle features 207, 209. FIG. 8 illustrates the handle features 207, 209 of the top panel 225 in detail. As shown, each of the handle features 207, 209 is at least partially defined by a respective curved edge 283, 285 that form respective portions of respective free edges of the top panel 225. As also shown, each handle feature 207, 209 is also at least partially defined by respective fold lines 287, 289 that can have a curved configuration, as shown, and which have respective endpoints that intersect the respective curved edges 283, 285. As shown, the fold lines 287, 289 each have a generally convex configuration relative to a longitudinal centerline CL3 of the top panel 225, e.g., each fold line 287, 289 extends toward respective endpoints in a direction extending away from the longitudinal centerline CL3.

As shown, the handle feature 207 includes a plurality of sections 291, 293, 295, with the central section 293 (broadly, "first central section") being centrally disposed between longitudinally marginal or outer sections 291 (broadly, "first outer section"), 295 (broadly, "second outer section"). As shown, the central section 293 is foldably connected to the outer section 291 at a curved fold line 297 and the central section 293 is foldably connected to the outer section 295 at a curved fold line 299. In the illustrated embodiment, the curved fold lines 297, 299 each extend between the curved edge 283 and the fold line 287 such that the fold line 287 is a common curved fold line (broadly, "first common fold line") at which each of the sections 291, 293, 295 are foldably connected to a body portion 226 of the top panel 225. As shown, each of the curved fold lines 297, 299 has a generally convex configuration relative to a lateral centerline CL4 of the top panel 225, e.g., each curved fold line 297, 299 extends toward respective endpoints in a direction extending away from the lateral centerline CL4. In this regard, and as shown, the central section 293 has a configuration that generally tapers from the fold line 287 to the curved edge 283. In the illustrated embodiment, the outer sections 291, 293 are defined by a portion of the curved edge 283, a portion of the curved fold line 287 and a respective curved fold line 297, 299. The sections 291, 293, 295 could be otherwise shaped, arranged, and/or configured without departing from the disclosure.

Still referring to FIGS. 7 and 8, the handle features 209 can have similarly-configured features to the handle features 207 described above. In particular, the handle features 209 include a central section 303 (broadly, "second central section"), and longitudinally marginal or outer sections 301 (broadly, "third outer section"), 305 (broadly, "fourth outer section"), with the central section 303 foldably connected to the outer sections 301, 305 at a respective curved fold lines 307, 309, and each of the sections 301, 303, 305 foldably connected to the body portion 226 of the top panel 225 at the curved fold line 289 such that the curved fold line 289 is a common curved fold line (broadly, "second common curved fold line). One or both of the handle features 207, 209 can be differently-configured without departing from the disclosure. The sections 301, 303, 305 are defined by the fold lines 289, 307, 309 and the curved edge 285 of the top panel 225.

Figure 9:
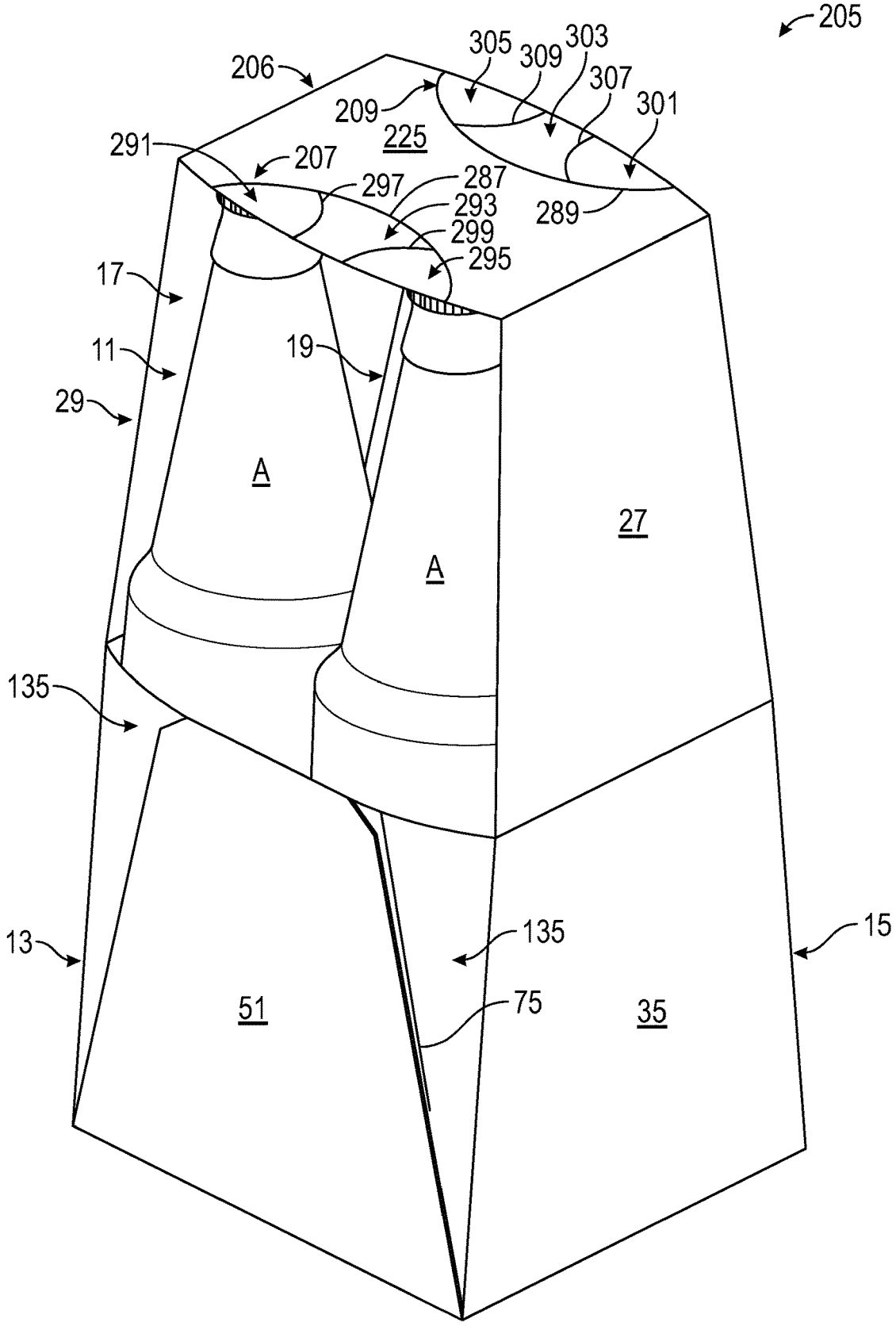
FIG. 9 is a perspective view of a carrier formed from the blank of FIG. 7 according to the second exemplary embodiment of the disclosure, and with at least one handle feature in a first configuration.
Figure 10:
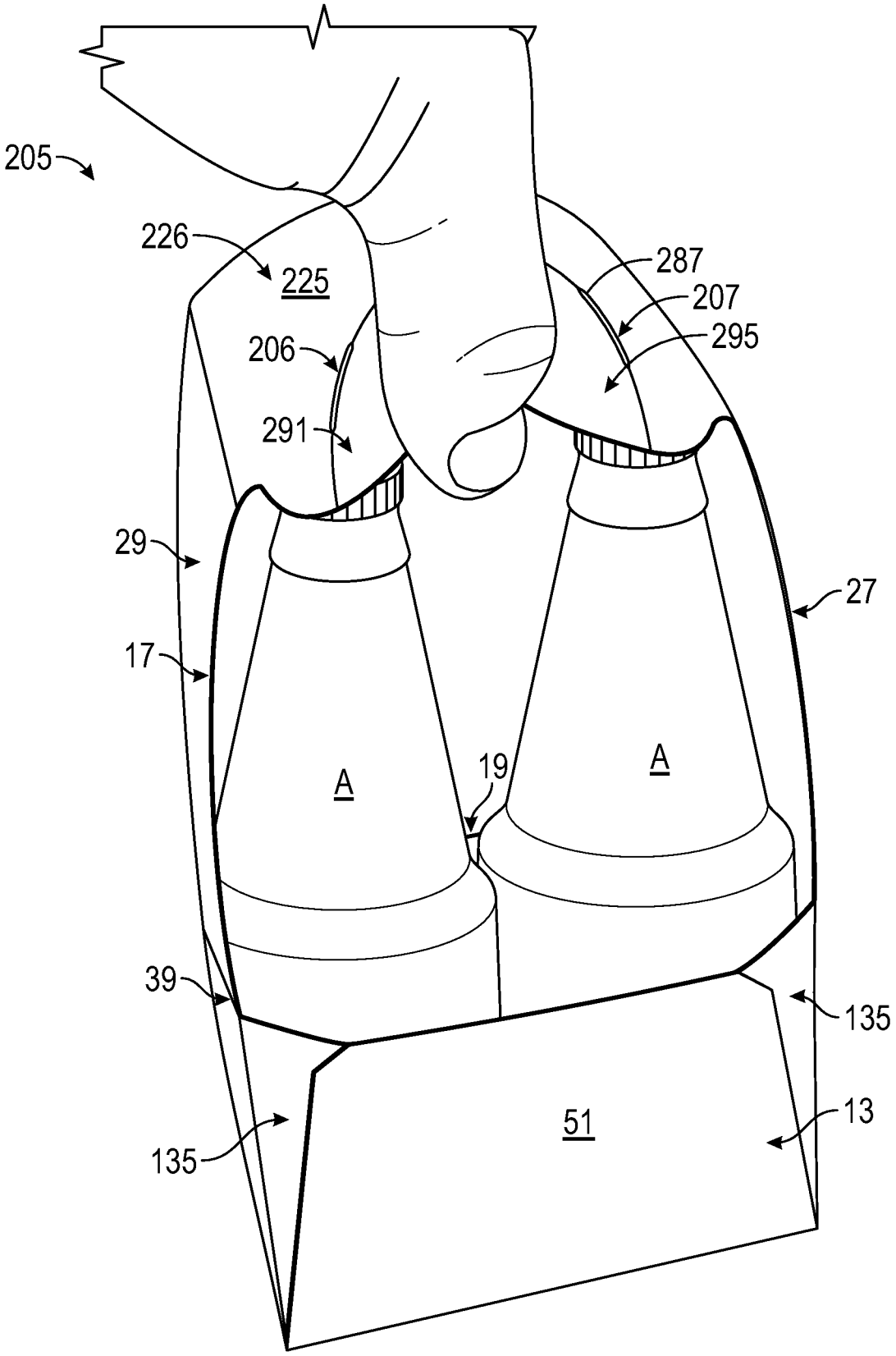
FIG. 10 is a perspective view of the carrier of FIG. 9 with the at least one handle feature in a second configuration.

Turning additionally to FIGS. 9 and 10, the carrier 205 can be formed in a similar manner as described above with respect to the carrier 5 (FIG. 5). As shown, a user can engage the handle 206 at one or both of the handle features 207, 209 to facilitate carrying of the carrier 205. As shown, the handle features 207, 209 are regions of the carrier 205 that are configured to at least partially deform, e.g., bend, crush, crumple, and/or fold, in order to present one or more surfaces that facilitate engagement by a user, for example, a user's fingers. As shown, the respective sections 291, 293, 295 and 301, 303, 305 are configured for relative movement to one another such that the respective handle features 207, 209 deform downwardly or inwardly, e.g., toward and/or at least partially into the interior 11 of the carrier 205. In this regard, in the activated position of the handle 206, the handle features 307, 309 can deform into respective substantially concave recesses relative to the body portion 226 of the top panel 225.

In one configuration, as shown, the central section 293 of the handle feature 207 can be pressed downwardly or inwardly to at least partially fold at the fold line 287 into substantially oblique or substantially perpendicular arrangement with the body portion 226 of the top panel 225. Such movement of the central section 293 causes the respective outer sections 291, 295 to become downwardly disposed relative to the body portion 226 of the top panel 225 and obliquely disposed relative to the central section 293 by folding at the respective fold line 287 and the curved fold line 297, and at the fold line 287 and the curved fold line 299, respectively, to form the recessed configuration of the handle 206. In the activated configuration of the handle 206, the sections 291, 293, 295 may engage a portion of a user's fingers, for example, by at least partially hugging, clamping, and/or clasping around a user's fingers in a non-injurious fashion, such that the user is provided with a secured engagement of the carrier 205 upon engagement of the handle feature 207. In this regard, the handle feature 207 is configured to transition between a first, substantially flat configuration, and a second, activated configuration as described above.

The handle feature 209 of the handle 206 can be engaged and activated by a user from a first, flat configuration to a second, activated configuration in a similar manner as described above with respect to the handle feature 207, for example, so that the central section 303 is pressed downwardly to at least partially fold at the fold line 289 into substantially oblique or substantially perpendicular arrangement with the body portion 226 of the top panel 225, and with the sections 301, 305 downwardly disposed relative to the top panel 225 and obliquely disposed relative to the section 303 by folding at the respective fold line 289 and the curved fold line 307, and at the fold line 289 and the curved fold line 309, respectively, to form the recessed configuration of the handle 206. In the activated position of the handle 206, the body portion 226 of the top panel 225 is generally arched upwardly between the side panels 27, 29 to facilitate grasping the handle 206, for example, by contacting the palm of a user's hand.

It will be understood that one or both of the handle features 207, 209 of the handle 206 can have a different pattern of deformation, or that the patterns of deformation described above can occur differently, e.g., in a different order, without departing from the disclosure.

As described herein, the handle features 207, 209 provide the carrier 205 with an at least partially deformable structure that provides one or more engagement surfaces for carrying of the carrier 205. Following an initial deformation of the handle features 207, 209 as described above, the handle 206 may be configured to remain in such deformed or activated configuration for subsequent use, for example, due to the engagement of one or both of the edges 283, 285 with respective portions of the articles A, e.g., the caps C. In one embodiment, one or both of the handle features 207, 209 can have an at least partially resilient configuration, for example, such that one or both of the handle features 207, 209 can be biased or otherwise configured to return from a deformed or activated position to a non-deformed or flat configuration.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carrier to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton or carrier embodiments. The term "glue" is intended to encompass all manner of adhesives commonly used to secure carton or carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A blank for forming a carrier for holding at least one article, the blank comprising:

a plurality of panels comprising a top panel, a bottom panel, and at least one side panel; and at least one handle feature in the top panel for forming a handle of the carrier formed from the blank, the at least one handle feature comprises a plurality of foldably connected handle sections that comprises a first outer section and a second outer section each foldably connected to a central section, each of the first outer section, the second outer section, and the central section are foldably connected to a body portion of the top panel at a curved fold line, the central section tapers from the curved fold line to a free edge of the top panel.

2. The blank of claim 1, wherein the curved fold line is convex relative to a longitudinal centerline of the top panel.

3. The blank of claim 2, wherein the curved fold line has endpoints at a free edge of the top panel.

4. The blank of claim 1, wherein the first outer section is foldably connected to the central section at a first curved fold line and the second outer section is foldably connected to the central section at a second curved fold line.

5. The blank of claim 4, wherein each of the first curved fold line and the second curved fold line is convex relative to a lateral centerline of the top panel.

6. The blank of claim 1, wherein the at least one handle feature further comprises a first tab foldably connected to the first outer section and a second tab foldably connected to the second outer section.

7. The blank of claim 6, wherein the first tab and the second tab are separated from respective marginal portions of the first outer section and the second outer section at a respective cut.

8. The blank of claim 7, wherein the respective cut is a respective curved cut.

9. The blank of claim 8, wherein the respective curved cut at least partially defines a respective locking edge of the respective marginal portions.

10. The blank of claim 1, wherein the at least one handle feature is a first handle feature and the central section is a first central section, and the handle comprises a second handle feature in the top panel, the second handle feature comprising a third outer section and a fourth outer section foldably connected to a second central section.

11. The blank of claim 1, wherein the at least one side panel comprises a first upper side panel and a second upper side panel each foldably connected to the top panel.

12. The blank of claim 9, wherein the at least one side panel further comprises a first lower side panel foldably connected to the first upper side panel and a second lower side panel foldably connected to the second upper side panel.

13. The blank of claim 1, wherein the at least one handle feature is positionable between a first, substantially flat configuration and a second, substantially recessed configuration wherein the handle is activated for carrying the carrier formed from the blank.

14. A method of forming a carrier for holding at least one article, the method comprising:

obtaining a blank, the blank comprises a plurality of panels comprising a top panel, a bottom panel, and at least one side panel, the blank comprises at least one handle feature in the top panel for forming a handle, the at least one handle feature comprises a plurality of foldably connected handle sections that comprises a first outer section and second outer section each foldably connected to a central section, each of the first outer section, the second outer section, and the central section are foldably connected to a body portion of the top panel at a curved fold line, the central section tapers from the curved fold line to a free edge of the top panel; and folding the plurality of panels at least partially around an interior of the carrier.

15. The method of claim 14, wherein the curved fold line is convex relative to a longitudinal centerline of the top panel.

16. The method of claim 15, wherein the curved fold line has endpoints at a free edge of the top panel.

17. The method of claim 14, wherein the first outer section is foldably connected to the central section at a first curved fold line and the second outer section is foldably connected to the central section at a second curved fold line.

18. The method of claim 17, wherein each of the first curved fold line and the second curved fold line is convex relative to a lateral centerline of the top panel.

19. The method of claim 14, wherein the at least one handle feature further comprises a first tab foldably connected to the first outer section and a second tab foldably connected to the second outer section.

20. The method of claim 19, wherein the first tab and the second tab are separated from respective marginal portions of the first outer section and the second outer section at a respective cut.

21. The method of claim 20, wherein the respective cut is a respective curved cut.

22. The method of claim 21, wherein the respective curved cut at least partially defines a respective locking edge of the respective marginal portions.

23. The method of claim 14, wherein the at least one handle feature is a first handle feature and the central section is a first central section, and the handle comprises a second handle feature in the top panel, the second handle feature comprising a third outer section and a fourth outer section foldably connected to a second central section.

24. The method of claim 14, wherein the at least one side panel comprises a first upper side panel and a second upper side panel each foldably connected to the top panel.

25. The method of claim 24, wherein the at least one side panel further comprises a first lower side panel foldably connected to the first upper side panel and a second lower side panel foldably connected to the second upper side panel.

26. The method of claim 14, wherein the folding the plurality of panels comprises positioning the at least one handle feature between a first, substantially flat configuration and a second, substantially recessed configuration wherein the handle is activated for carrying the carrier.

* * * * *